United States Patent [19]

Camacho et al.

[11] 3,980,467

[45] Sept. 14, 1976

[54] METHOD OF OPERATING A BATCH TYPE ANNEALING FURNACE USING A PLASMA HEAT SOURCE

[76] Inventors: Salvador L. Camacho, O'Neal Road, Raleigh, N.C. 27602; James K. Magor, 3555 Hamstead Court, Durham, N.C. 27707

[22] Filed: June 17, 1974

[21] Appl. No.: 480,235

Related U.S. Application Data

[62] Division of Ser. No. 332,919, Feb. 16, 1973, Pat. No. 3,816,901.

[52] U.S. Cl. ..... 75/10 R; 13/34; 75/65 EB

[51] Int. Cl.[2] ..... C22B 4/00

[58] Field of Search ..... 13/34; 75/10, 65 EB

[56] References Cited

UNITED STATES PATENTS

| | | | |
|---|---|---|---|
| 3,013,315 | 12/1961 | Smith | 75/65 EB |
| 3,480,426 | 11/1969 | Neuenschwander | 75/10 R |
| 3,771,585 | 11/1973 | Ulrich | 75/10 R |
| 3,852,061 | 12/1974 | Wulff | 75/10 R |

*Primary Examiner*—Peter D. Rosenberg
*Attorney, Agent, or Firm*—B. B. Olive

[57] ABSTRACT

A method for heat treatment, i.e, annealing or softening, of metal materials in the nature of coiled rod, wire, strip sheet, and the like, utilizes a conventional batch type furnace with a controlled atmosphere heated by an electric arc source, i.e., a plasma generator.

9 Claims, 8 Drawing Figures

METHOD OF OPERATING A BATCH TYPE ANNEALING FURNACE USING A PLASMA HEAT SOURCE

CROSS-REFERENCE TO RELATED APPLICATION

This application is a division of copending application Ser. No. 332,919, filed Feb. 16, 1973, now U.S. Pat. No. 3,816,901, entitled "Method of Converting a Fuel Burning Batch Annealing Furnace to a Gas Plasma Heat Source" (amended title), and which makes cross reference to other related applications.

BACKGROUND OF THE INVENTION

1. Field of the Invention

This invention is related particularly to batch furnace methods using arc column forming plasma generators for heating gases used in annealing of softening coiled rod, wire, strip and similar metals.

2. Description of the Prior Art

It is a well-known practice in the production of ferrous and non-ferrous sheet, rod and wire to subject the product to heat treatment for varying lengths of time and under varying atmospheric conditions. Such heat treatment may be adapted to effect certain physical changes as in normalizing and annealing, or by heating the product in the presence of a controlled reactant atmosphere to effect certain solid-state chemical changes as in carburizing, decarburizing, nitriding, denitriding, oxidizing, reducing, etc.

The practice of annealing low carbon sheet or strip steel, for example, has included continuous as well as batch-type methods of annealing. In continuous annealing, a steel strip is annealed while passing as a single strand through a furnace. The furnace atmosphere may or may not be "controlled". The degree of softening obtained is governed by the maximum temperature of the strip. The maximum temperature of the strip in turn depends on the energy radiated from heat sources, the thickness of the strip, and the rate of transit through the furnace. A continuous normalizing furnace without atmosphere control may use burners whose products of combustion play directly on steel sheet but produce a scale that can be tolerated. It has not been known, however, so far as applicants are informed, to use such products of combustion and at the same time to obtain a scale-free steel. Because transit time through the furnace limits the temperature to which the strip can be heated and hence limits the strip thickness, and because the relatively rapid cooling of a continuously annealed strip imparts higher hardness and a quench aging tendency than does batch-type annealing, the continuous annealing process is limited to light gauge product of restricted use. The major portion of present ferrous sheet and strip heat treating is, therefore, carried out in batch-type furnaces.

The conventional and widely used batch-type furnace comprises one or more stationary "diffuser bases" which house a recirculating fan and on which the charge to be annealed or otherwise heat treated is supported. A cylindrical removable steel inner cover encloses the charge, and an outer refreactory lined cover is lowered over the assembly. The outer refractory lined cover serves as a thermal barrier during heating and permits a controlled cooling cycle. The relatively thin inner cover dissipates and transfers heat rapidly, confines the controlled atmosphere during heating and preserves the controlled atmosphere during cooling until the temperature of the charge is sufficiently low to prevent scaling when exposed to ambient air. The strip steel is ususally tightly wound around a vertical mandrel and the resulting "hard wound" coils may be stacked on top of each other. Rod is wound around a similar mandrel and several such coils may be placed adjacent one another on the diffuser base.

In an alternate batch-type heat treating practice, sheet steel is loosely wound around a vertically disposed mandrel, each lap being separated from adjacent lap by a wire or nylon cord separator. Because the entire surface of such an "opened" coil is exposed to a gas of known and controllable composition, annealing practices, for example, have also included changing the chemical composition of the coil by solid state reactions during the "annealing" process by admitting certain reactant gases, e.g., moistened hydrogen, to the treating chamber.

In either case of hard coil or open coil batch-type annealing, the lift-off cover is in place about the inner cover during the heat-up, during the soak period, and during a portion of the cooldown cycle, if uncovering of the inner cover at the end of the soak period would result in too rapid a cooling rate or dangerous exposure of the surroundings to excessive heat. At the end of the cooling cycle, the inner cover is kept over a steel charge until the inside temperature has dropped sufficiently to ensure an oxide-free steel surface on exposure to ambient air. It is to be noted that the same high convection protective atmosphere batch-type annealing equipment is in widespread use in the rod and wire industry. Also, note that some batch annealing furnaces have stationary outer covers and raise and lower the hearth floor to place the inner cover and and charge within the outer cover.

In batch furnaces according to the prior art there is supplied a controlled atmosphere gas to the volume enclosed by the inner cover which in turn is heated by gas-fired radiant tubes or direct-fired or semi-direct-fired burners which line the interior lift-off cover and heat the inner cover. The thermal energy required to heat the charge from ambient to a selected high temperature must pass through the annular space between the outer cover and the inner cover, through the wall of the inner cover where it is transferred to the controlled atmosphere gas, and then to the charge. Convection, radiation and conduction heat transfers are involved. Much energy is lost in the above process. It is widely known that in conventional batch furnaces thermal efficiencies, i.e., the fuel energy that reaches the charge, are limited to about 50% even when using radiant gas-fired tubes which have been reported to be the most efficient source of heat energy in furnaces of this kind. Due to the relatively inefficient method of heating the charge, a substantial thermal head must be maintained in conventional annealing furnaces. By this is meant that the temperature at the radiant tubes must be maintained substantially higher than the temperature in the inner cover. Annealing practice in batch furnace operation calls for a furnace control period during which the charge is brought up to a work temperature. As an example, a radiant tube gas temperature in excess of 1800°F is normally required to heat the inner cover atmosphere to a work temperature of 1275°F. The time varies between furnaces and different charges, but generally requires 10–20 hours. Thus, a substantial amount of furnace time is involved in heating the inner cover atmosphere in conventional annealing batch furnaces, prior to the soak in the temperature cycle.

U.S. Pat. No. 3,109,877 is directed to an apparatus for heat treating loosely wound metal coils. A gas-fired tube or electrical resistance heat source heats a volume of controlled atmosphere gas which is fan driven into an open coil treating chamber. While open coil heat treatment of ferrous sheet is widely used in the steelmaking industry in conjunction with lift-off batch furnaces of the above described class, such an apparatus for heating the controlled atmosphere gas, as disclosed in the above U.S. patent has not been commercially successful for a number of practical reasons but primarily due to the substantially low thermal efficiencies which are obtained from heating the controlled atmosphere gas with conventional gas burners and electrical resistance coils.

Related to the above discussion, it should also be recognized that the steel industry has used batch-type furnaces since the early 1930's but there has been no substantial change in the methods and apparatus used to heat and control the annealing atmospheres in the inner covers of the batch furnaces. In other areas of steelmaking concerned with reduction and melting processes, it has long been known to use an electric arc as a heat source. See, for example, U.S. Pat. No. 1,479,662. A more recent innovation in the steel industry in the United States, Germany, Russia and Japan has been the introduction of furnace wall or internally mounted plasma arc generators for use in melting and refining wherein the plasma electric arc has been employed as a source of heat in melting and in liquid state refining processes. In this connection, reference should be made to previously cited copending applications, to German Pat. No. 1,206,531 having an "Armeldetag" date of May 28, 1963, and U.S. Pat. Nos. 3,422,206; 3,496,280; and 3,524,006. The employment of a plasma generator within a vessel for vessel space preheating has also been recognized in the previously referred to copending application Ser. No. 283,514 in which the space heated has no relation to a controlled atmosphere. None of these references or any other known references dealing with employment of electric arcs and more specifically with plasma arcs have suggested any application of an externally mounted plasma generator in connection with heating and controlling an atmosphere in a batch-type annealing furnace for solid-state heat treatment and chemical modification. More specifically, none of such references has suggested the possibility of converting conventional batch furnaces from fossil-fired fuel operations in which the inner cover atmosphere is indirectly heated over a long period of time to a system in which a plasma gas is heated externally of the furnace and the same gas is used both to sustain the plasma arc and to provide an atmosphere treating gas which can be introduced and brought up to a temperature near the working temperature in the inner cover within a matter of minutes as compared to the hours of time heretofore required.

The invention in one aspect directs itself to a method of converting a conventional fossil fuel fired batch furnace. Therefore, it is appropriate to recognize that others in the prior art have converted fossil fuel fired heating apparatus to electrically heated apparatus and in this regard reference is made to U.S. Pat. No. 3,691,344. However, neither this reference nor any other similar reference known to applicants makes any reference to the specific subject matter of this invention; namely, that of converting a fossil fuel fired batch-type annealing furnace for treating metals in a solid state to a furnace utilizing direct heated plasma gas as the atmosphere gas. The overall subject of batch furnaces has been widely reported as well as the critical features concerned with furnace atmospheres. Reference is made to the publication "Recent Developments in Annealing", Special Report 79, published in England, 1963, by the Iron and Steel Institute. This publication discusses the practices of the industry in batch annealing as of this date and such practices have generally not changed since such date. The many critical features concerned with furnace atmospheres are described in the publication "Furnace Atmospheres and Carbon Control", published by the American Society for Metals in 1964. A sales Bulletin LW1255, published by the Lee Wilson Engineering Company, Inc., of Cleveland, Ohio, shows in some detail typical batch furnaces being employed for rod and wire annealing. controlled atmosphere furnaces of various kinds are also described in a sales leaflet identified as Form No. SC-97 published by the Surface Combustion Corporation, Toledo, Ohio, and entitled "The ABC's of Prepared Atmospheres". Another useful reference to illustrate typical conventional batch furnace operation when directed to open coil annealing is to be found in the article entitled "Use of Open Coil Process to Change Composition and Improve Sheet Steels" to be found in the publication "Iron and Steel Engineer", May 1961. U.S. patent references dealing with the subject of batch or box annealing include U.S. Pat. Nos. 2,602,034; 2,603,577; and 3,127,289.

From the foregoing description of the prior art, those skilled in the art will recognize that batch furnace constructions and methods of operation have basically remained static since their introduction in the 1930's and even though electric arc and plasma generated arcs have made their appearance in other phases of steelmaking there has been no recongition or suggestion, prior to the present invention, that plasma arc gases can be used both as an atmosphere gas for annealing as well as a gas to sustain the plasma arc and that an external mounted plasma generator can be used as a basis for converting conventional fossil fuel fired batch furnaces to an entirely different mode of operation. The known and well recognized disadvantages of batch furnaces include the difficulty of maintaining uniform temperature, hot spot overheating, refractory maintenance, inner cover maintenance, low fuel efficiency, ignition explosions, limited inner cover life, and disposing of combustion products. Yet, since the early 1930's there has been no substantial way of avoiding or minimizing these problems and disadvantages and such becomes the object of this invention.

SUMMARY OF THE INVENTION

The invention is broadly directed to using a gas which sustains an electric arc to both heat and provide a controlled atmosphere within the inner cover of a batch-type annealing furnace. More specfically, the invention in a preferred embodiment employs a plasma arc generator in such a furnace configuration. A long arc column type plasma generator such as described in U.S. Pat. No. 3,673,375 is preferred. The temperature of the atmosphere within the inner cover is controlled by sensing such temperature at the bottom and top of the charge as well as the temperature of the plasma heated treating gas before it enters the inner cover. These sensed temperatures are used to electrically control the amounts of plasma treating gas which enter and bypass the plasma generator. An electrically controlled proportioning valve performs this function. An increase in plasma treating gas passed through the generator increases the atmosphere temperature within the inner cover whereas an increase in the amount of plasma treating gas which bypasses the plasma generator results in a decrease in the inner cover atmosphere temperature. The sensed temperatures may also be used to electrically control the plasma generator power supply and the energy supplied to the plasma generator as a means of controlling the inner cover atmosphere temperature.

Provision is made for employment of an auxiliary gas supply which can be used in conjunction with the plasma treating gas to obtain desired end results in the overall annealing process. The invention is also directed to the method of converting a conventional batch furnace from a fossil fuel fired operation to a plasma arc generator operation and from an indirect type of heating the inner cover atmosphere to a direct system of heating.

DESCRIPTION OF THE PREFERRED EMBODIMENT

Figure 4:
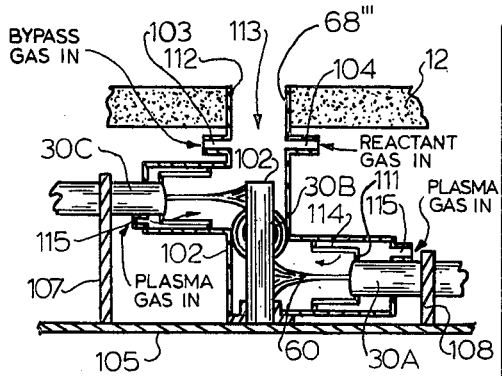
FIG. 4 is a cross-sectional side view of plural long arc plasma generators in operative arrangement with a manifold structure used in another invention embodiment.

Once the overall concept of using at least a portion of a plasma sustaining arc gas as an atmosphere gas for the inner cover of a batch furnace is revealed to those skilled in the art there will appear a substantial number of practical configurations which might employ this broad concept. Therefore, the example which follows should be taken as being exemplary and representative of a wide variety of possible configurations as well as possible methods of employing a plasma generator in this manner. Also, while it is contemplated that other types of electric arc and plasma generated arcs might be found to suit the purposes of the invention, a much preferred system is based on employement of a long arc column plasma generator such as described in U.S. Pat. No. 3,673,375. Only the broad details of such a plasma generator are revealed in the drawings and description to follow since the prior art references may be used to amplify any necessary detailed information. Also, only the broad physical arrangement of the batch furnace is shown since the same prior art references reveal the more detailed construction features. Also, no attempt has been made in the drawings to distinguish between a batch furnace used for open coil annealing as distinguished from closed coil annealing and the drawings and description to follow are based on closed coil annealing. The addition of a plenum chamber for open coil annealing and other changes that may be required for annealing rod, wire, and the like, will be readily apparent to those skilled in the art from the information which is given.

Figure 1:
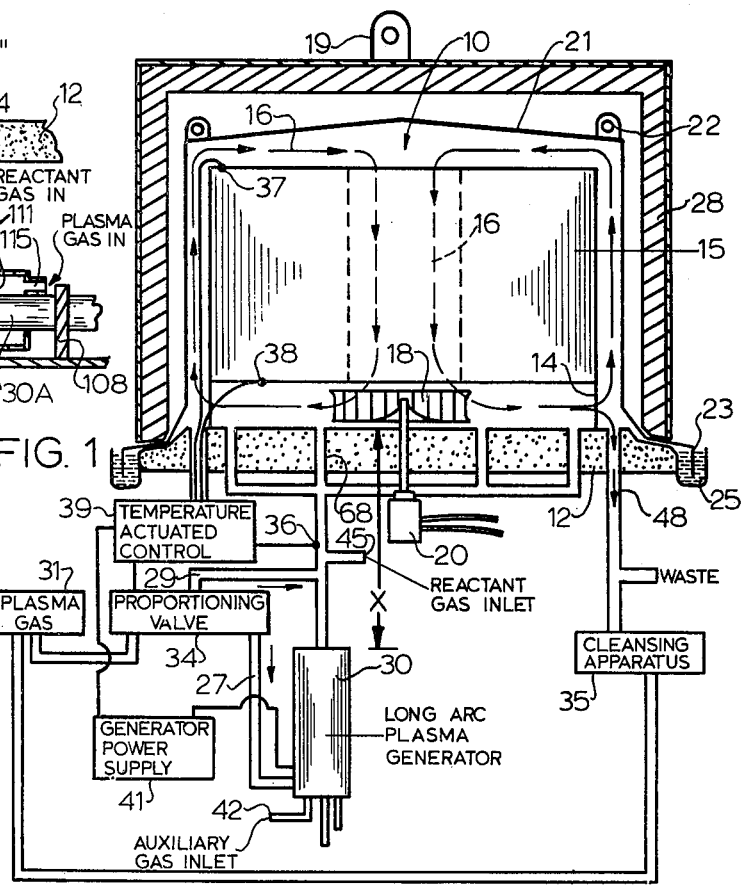
FIG. 1 is a generalized block diagram of the preferred invention embodiment.

Referring to FIG. 1, the apparatus and method of the preferred embodiment utilizes a conventional batch annealing furnace apparatus, generally designated 10, comprising a floor 12, a so-called "diffuser base" 14 mounted on said floor and which supports a charge 15 to be heat treated. Here the charge is represented as a closed or "hard" sheet coil merely as an example. A fan 18 is centrally located in diffuser base 14 and is driven by a suitable motor 20. A removable cylindrical steel inner cover 21 having an open lower end and a closed top end is lowered over the charge and base assembly by means of appropriate lifting eyes 22. Inner cover 21 defines a "treating chamber" in which the atmosphere gas is contained. The bottom edges 23 of such inner cover 21 are sealed by oil 25, sand, deformable rubber, or other suitable means, to create a substantially airtight volume beneath the inner cover. A refractory-lined cylindrical outer cover 28 having a closed top end and an open bottom end, i.e., a bell-like or open-ended box shape, is lowered over inner cover 21 by means of lifting eye 19. Outer cover 28 provides a heat barrier as previously described in the prior art description and is is preferred, though not necessary, that the usual radiant tube heaters or direct-fired burners (not shown) be removed from the interior of outer cover 28. While it is recognized that inner cover 21 and lift-off cover 28 may be combined into a single lift-off cover, it is contemplated that both will continue to be used and particularly since they serve useful purposes previously described. Further, the problem of converting to the system and method of the present invention is greatly simplified.

According to the invention, an externally mounted plasma generator 30 is adapted to be operated on a gas which is used to form the plasma arc column, is heated in such arc forming and is then passed to the inner cover 21 as the heated controlled atmosphere. In the preferred embodiment shown in FIG. 1, a variable portion of the treating gas becomes the plasma gas and is conducted to plasma generator 30 via conduit 27 and the remainder of the treating gas bypasses plasma generator 30 via conduit 29. The amount of treating gas passed through plasma generator 30 is regulated by operation of an electrically controlled proportioning valve 34 as one means to control the temperature of the heated atmospheric gas within inner cover 21. In an automatic temperature regulating mode thermocouples 37 and 38 are secured to top and bottom portions of the charge 15 and, through a suitable temperature actuated electric control, control the proportioning or ratio valve 34 in a predetermined manner, e.g., if more heat is required in the atmosphere within inner cover 21, more treating gas is passed through plasma generator 30 and if less heat is required less gas is passed through. A supply of treating gas, generally designated 31, may be obtained from any suitable source. Since temperature controls, proportional valves, and the like, are well-known, no further detailed description is deemed necessary.

The composition of the plasma and treating gas 31 may be substantially any atmosphere gas useful in heat treating a charge 15. Typically, such treating gas may comprise the exothermic or hydrogen-nitrogen types. If the composition of a particular treating gas is found to have corrosive effects on the internal parts of plasma generator 30 when being used to form the plasma column, an auxiliary gas inlet 42 may be used to supply an inert and treating plasma forming gas such as argon to plasma generator 30. Such auxiliary inert gas when used enables substantially all or part of the corrosive treating gas to bypass plasma generator 30. In this case, the auxiliary gas becomes both the plasma gas and a heat carrier gas forming part of the atmospheric gas fed to the treating chamber formed by inner cover 21. In addition, a reactant gas inlet 45 is provided for admitting certain reactant gases, steam, methane, ammonia, etc., into inner cover 21 at a predetermined stage of the heat treatment process.

What becomes particularly significant is that this invention recognizes that a vast number of gases which are suited to forming long arc plasma columns are also suited to use as a heated atmospheric gas for annealing. Thus, the invention method and apparatus readily adapts to the prepared treating atmospheres in common use in industry: exothermic, endothermic, nitrogen, hydrogen-nitrogen, and dissociated ammonia. The same gas may thus serve as a plasma gas, a heat carrier, and as a treating gas for modifying the chemical composition of the charge in solid-state reactions.

In a simplified method of the invention based on the apparatus shown in FIG. 1 after a charge 15 is placed on diffuser base 14, thermocouples 37 and 38 inserted, inner cover 21 and outer insulated cover 28 lowered into position, the inner cover volume, i.e., the treating chamber, is purged at room temperature with a non-combustible controlled atmosphere gas which is admitted from gas source 31 and thence through bypass conduit 29 and through manifold conduits 68 to reduce oxygen content within the inner cover 21 to non-scaling and non-explosive limits. Typically, with an inner cover free volume of 650 cubic feet and a flow of 3250 cubic feet per hour of an oxygen free purging gas, e.g., an exothermic gas of composition: 86.0% nitrogen, 10.5% carbon dioxide, 1.5% carbon monoxide, 1.2% hydrogen, 0.8% water vapor, the oxygen content within the inner cover will be reduced to less than 0.2% in approximately one hour. An appropriate gas outlet 48 allows purged oxygen rich gas to escape during the above cycle. Circulation is in the direction indicated by arrows 16. Outlet 48 is also used to bleed the controlled atmospheric gas from inner cover 21 during annealing at the same rate as it is introduced. An alternate to disposing of the controlled atmosphere through outlet 48 as waste product is to route this gas through appropriate cleansing apparatus 35 (FIG. 1) preceding its reuse as a plasma and heat treating gas.

After purging the treatment chamber formed by inner cover 21, the temperature control 39 is set to the temperature control setting required for the specified heat treatment. A constant flow of gas is established at source 31. The plasma generator cooling system is started. The plasma arc is struck in generator 30. control of the relative quantities of the gas stream passing through conduits 27 and 29 are in this mode of operation automatically controlled by the temperature controlled proportioning valve 34 according to the temperature desired. When either the temperature spread between thermocouples 37 and 38 exceed a predetermined margin, say 100°F., or when either said thermocouple reaches the set treating temperature, say 1280°F., a sufficient amount of treating gas is caused to bypass plasma generator 30 in order to maintain the desired treating temperature within the chamber formed by inner cover 21. The heated gas mixture, i.e., the controlled atmospheric gas, formed by the heated plasma gas and any unheated gas added thereto is, of course, admitted to inner cover 21 through as short a path as possible to minimize heat losses and pipe friction. In FIG. 1, gas entry through floor 12 into inner cover 21 makes use of a manifold type of piping 68. FIG. 1 is intended to indicate a plural peripheral spacing of the gas inlets into cover 21. In whatever application, it is desirable that the spacing "X", FIGS. 2 and 3, be at least equal to three to four generator nozzle diameters to ensure that the extreme central line heat of the arc does not play on the diffuser, the fan, or the like, to cause overheating. That is, the heated plasma should not come into direct contact with furnace parts until the plasma has traveled enough distance to provide temperature equalization throughout the plasma. Either a single, closely coupled floor entry as in FIGS. 2, 3, 4 and 5 or a multiple, more remotely coupled, floor entry as depicted in FIG. 1 may be used according to the application.

Figure 2:
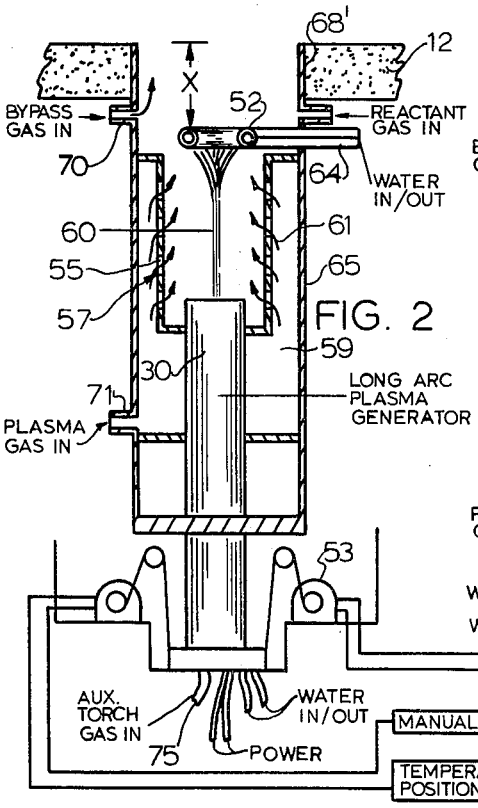
FIG. 2 is a cross-sectional side view of a long arc plasma generator in operative arrangement with a movable external electrode, used in the preferred embodiment of the instant invention.

Referring next to FIG. 2, in one embodiment the instant invention utilizes an externally mounted long arc column forming plasma generator 30 of the general type previously described in the above cited U.S. Pat. No. 3,673,375. This patent teaches the utilization of an external, fixedly positioned, ring-shaped electrode in combination with a long arc column plasma generator to generate a long arc plasma column therebetween. An external water cooled, ring-shaped electrode 52 is fixedly mounted forward of and in axial alignment with plasma gnerator 30. Plasma generator 30 is positionable with respect to forward electrode 52 by appropriate lifting means 53 enabling striking of a long arc column in accordance with the teachings of the cited patent. Remote control of lifting means 53 to control the annealing gas temperature may be employed as is schematically shown in FIG. 2. A cylindrical manifold 55 having a plurality of air vent apertures 57 is adapted to reside in proximity to the long plasma arc column 60 such that radiant energy from the arc column 60 is absorbed by manifold 55 which in turn transmits heat to treating gas 59 forced through vent apertures 57. Note direction of arrows 61. Plasma generator 30, electrode 52, manifold 55 and appropriate gas and water couplings 63, 64 are suitably enclosed in a cylindrical housing 65 adapted to couple with a gas inlet aperture 68′ in the hearth floor 12. Note that the plasma generator embodiment shown in FIG. 2 utilizes a treating gas inlet at 71 corresponding to conduit 27 of FIG. 1, to heat the gas by passing it through apertures 57 in manifold 55, and a bypass inlet 70 corresponding to conduit 29 of FIG. 1 to shunt unheated gas around manifold 55, in order to control the temperature of the treating chamber. Auxiliary gas inlet 75 enables plasma generator 30 to operate from the same supply of treating gas, or, if such gas is of a corrosive nature with respect to interal plasma generator components, from an auxiliary supply of inert gas, e.g. argon (not shown).

Figure 3:
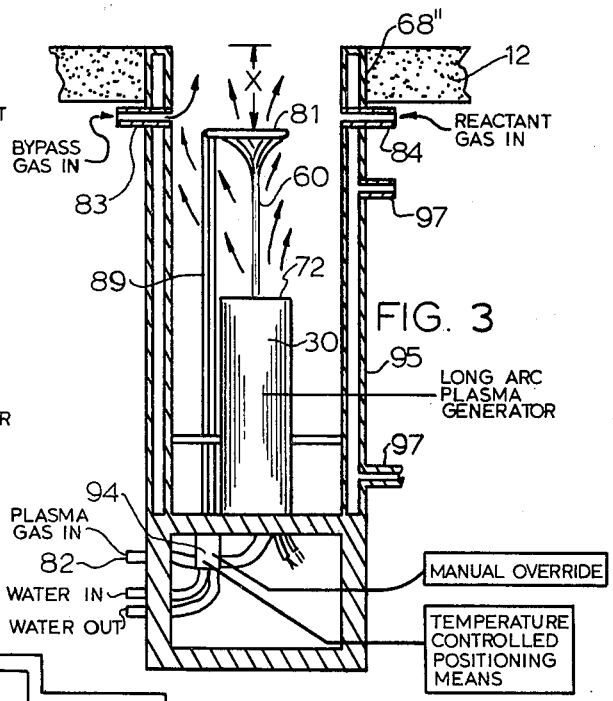
FIG. 3 is a cross-sectional side view of a long arc plasma generator in operative arrangement with a manifold structure used in an alternate invention embodiment.

Referring now to FIG. 3 is still another embodiment, the invention utilizes a long arc column forming plasma generator of the type previously shown and described in the above cited copending application Ser. No. 283,514. Such application teaches a long arc plasma generator 30 having a ring-shaped non-consumable forward electrode 81 which is positionable with respect to the plasma generator nozzle. In the embodiment shown in FIG. 3, gas inlet 82 provides treating gas to plasma generator 30. In this particular embodiment, the elongated external electrode structure 89 having the ring-shaped tip portion 81 resides forward of and in spaced axial alignment with the forward or "nozzle end" 72 of plasma generator 30 and is adpated for rectilinear movement along the plasma generator axis by appropriate hydraulic or gear driven positioning apparatus 94. Electrode 89 is preferably water cooled to prevent tip portion 81 from being consumed by the heat of the arc column. Plasma generator 30 and movable electrode 89 in this embodiment are supported by a cylindrical water-cooled housing 95 which serves as a plenum chamber for directing heated treating gas, a component of the long arc column, upward through floor aperture 68'' and into the treating chamber. Appropriate water inlet and outlet couplings 97 are provided for cooling housing 95.

FIG. 3 diagrammatically illustrates how positioning apparatus 94 may be temperature controlled to control arc length and thereby control the annealing gas temperature.

It is important to note that all embodiments require a predetermined minimum quantity of treating gas flowing at a given velocity based on vortex chamber and nozzle dimensions in order that the long arc column 60 can be successfully maintained. Thus, the lower bound of gas flow through plasma generator 30 should not be diminished any more than necessary by whatever pipe and valve arrangement is used in order to avoid extinguishing the arc.

Figure 5:
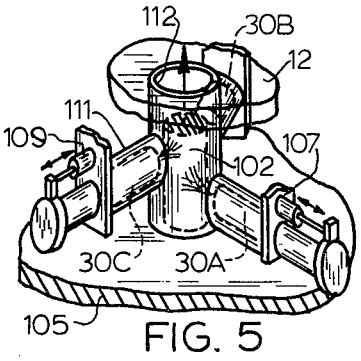
FIG. 5 is a persepctive view showing the plural long arc plasma generator and manifold arrangement of FIG. 4.

Referring now to FIGS. 4 and 5 which respectively show side and cutaway perspective views of a third plasma generator embodiment for heating a volume of plasma gas suited to being a treating gas in accordance with the instant invention, a plurality of plasma generators 30A, 30B and 30C are radially positioned around a central cylindrical graphite electrode 102 supported by appropriate suport members 107, 108 which are secured to a subfloor 105. A gas manifold 111, similar to manifold 55 of FIG. 2, is provided for each plasma generator and various manifolds are coupled to a central vertically disposed conduit 112 to form a treating gas plenum chamber 113 which is adapted to extend upward through a floor aperture 68''' in hearth floor 12. Graphite electrode 102 is connected to the plasma generator electrical circuit, not shown, which is most suitably a three-phase AC wye, and serves as a common external electrode for the three plasma generators utilized 30A, 30B and 30C. In a preferred mounting configuration of this embodiment, plasma generators 30A, 30B and 30C are located at 120° intervals around graphite electrode 102 and, in addition, are mounted at varying horizontal levels A, B and C, best shown in FIG. 4, to minimize interaction of the long arc columns; that is, objectionable attraction of adjacent arcs. Appropriate remotely controllable plasma generator positioning apparatus 109 is provided enabling remotely actuated temperature controlled positioning, now shown, and remotely actuated striking of the long arc columns. Such remote striking of a long arc column has been previously set forth in the above cited U.S. Pat. No. 3,673,375 and copending application Ser. No. 283,514, and therefore warrants no further elaboration herein.

Temperature regulation of the invention embodiment shown in FIGS. 4 and 5 is accomplished in a manner similar to that previously described. Referring specifically to FIG. 4, a treating gas inlet 115 is provided for each manifold 111 and each manifold 111 includes a plurality of apertures 114 which enable a volume of treating gas to be fed through the manifold and heated, and then be fed through conduit 112 into the treating chamber formed by inner cover 21. Heating of the gas passing through each manifold 111 is accomplished by direct radiation of each arc column 60, and by conductive and convective heat transfer associated with the heated manifold 111. In accordance with the invention, a variable amount of the total volume of treating gas is adapted to bypass such manifold 111 and enter the treating chamber through a bypass inlet 103. Such bypassed treating gas is continuously mixed with the heated volume of treating gas to control the temperature of the treating gas which is admitted to the treating chamber formed by inner cover 21. As in the case of previously described embodiments, a reactant gas inlet 104 is also provided for admitting a selected reactant gas such as steam, ammonia, etc., during a specified spage of a heat treating process. Since such reactant gas, purging gas, and the like, are normally available at the furnace, a conversion to the present invention apparatus would only require that they be connected to the invention apparatus. While not shown in FIGS. 4 and 5, it should also be noted that the embodiment of FIGS. 4 and 5 enables each plasma generator 30A, 30B or 30C to utilize either a portion of the treating gas supply or an auxiliary gas supply excusively as the plasma arc forming gas. In any event, the atmospheric gas reaching the interior of inner cover 21 will include the plasma gas from each of the generators 30A, 30B and 30C.

In each of the foregoing described plasma generator embodiments forming a portion of the present invention heat treating method and apparatus, accurate temperature regulation of the treating chamber temperature within inner cover 21 is accomplished by dividing a volume of treating gas into separate volumes, the relative quantities of which are continuously regulated. One such volume is heated directly by passing through a plasma generator or through a heated manifold associated with such generator while another such volume bypasses the plasma generator or associated manifold and is not heated directly but mixes with the heated gas to yield a treating gas of desired treating temperature. Regulation of the respective volumes of gas is accomplished by temperature actuated proportioning valve means only generally described but well-known to those skilled in the art. A specific means, as best shown in FIG. 1, for automatically operating such valve means is to couple a temperature actuated proportioning valve to appropriate thermocouple means residing at top and bottom temperature measuring points on the charge, thermocouples 37, 38.

In another mode of the invention illustrated in FIG. 1, however, temperature regulation of the treating chamber temperature within inner cover 21 is accomplished by suitable arc voltage and current regulation. Thus, as illustrated in FIG. 1, the temperature actuated control 39 may be used to control the plasma generator power supply 41. One such method is by introducing variable reactance, considered well-known in the art, into the arc circuit. Alternately, by varying the arc length of the long arc column by either of the above described plasma generator or external electrode positioning means, voltage and current are easily increased or decreased causing a corresponding increased or decreased temperature of the arc column and of the treating gas directly or indirectly heated by such arc column. Thus, the treating chamber temperature may be regulated accordingly. Since power controls for plasma generators are known for other applications, no detailed disclosure or discussion of such circuitry is given. The control 39 may, of course, be programmed so as to use gas bypass as a temperature control technique within certain portions of the cycle or at certain temperatures and use generator power supply regulation or arc length control in other stages. Further, it is desired to have a thermocouple 36 (FIG. 1) placed in the treating gas path at a point after it has been heated but before it enters the furnace and couple this thermocouple to control 39. The sensed temperature of the heated gas entering the chamber thus provides another electrical reference which may be used for temperature control of the annealing gas.

As will be best understood by those skilled in the art, the method of converting a conventional direct-fired, semi-direct-fired or radiant tube batch type annealing furnace to operate according to the embodiment of the invention shown in the drawings involves the following basic steps:

1. remove such conventional fuel burning equipment as is necessary to complete the conversion;
2. install a plasma generator, including any necessary cooling equipment, externally of the furnace and in proximity to its hearth floor;
3. form apertures in the hearth floor within the inner cover boundary and connect the same to receive heated gas from the plasma generator;
4. install and connect to the plasma generator an appropriate suply of a gas of a type which can be used both as a plasma gas and as a treating gas;
5. install and connect an appropriate power supply to the plasma generator;
6. install and connect and appropriate temperature control arranged to sense the furnace treating temperature and use the sensed values to control the temperature of the heated gas fed to the treating chamber portion of the furnace; and
7. install and connect any appropriate reactant and auxiliary gas supplies to the plasma generator and to the hearth apertures as required with the feed controls therefor being appropriately connected to the temperature control as required.

In most cases very little removal or alteration of existing fuel equipment will be required. Room is normally available below the hearth floor in which to install the apparatus of the invention, install and connect gas supplies, power supplies, coolants, temperature controls, and the like. The conventional gas outlets 48 are contemplated as being compatible with the fluid dynamics of the invention apparatus though the outlets may in some instances be formed as standpipes within the inner cover 21 to minimize heat losses. Thus, a very wide range of batch furnace installations can be converted at minimum expense and by making use of the existing inner and outer covers. Of course, individual installations may call for variations on the basic steps set forth above.

In operation, the method of operation would basically follow the following steps:

1. place the charge on the hearth floor;
2. install appropriate temperature sensors proximate the charge;
3. place the inner and outer covers;
4. purge the treating chamber, i.e., the inner cover, with an appropriate purging gas;
5. start a plasma generator mounted externally of the furnace and sustain its arc column with a supply of gas suited to being used both as the plasma column sustaining gas and at least as a portion of the controlled atmospheric gas;
6. start the flow of any required gases auxiliary to the plasma generator gas;
7. combine the heated plasma gas and the auxiliary gas, if any, in required proportions and pass the same through the hearth floor to the inner cover interior;
8. monitor the gas temperature within the inner cover and employ such temperature to control the temperature of the gas mixture entering such cover to maintain some predetermined time-temperature cycle; and
9. allow gas from said inner cover to exit during the time-temperature cycle at substantially the same rate as it is introduced thereto.

The basic plasma generator assembly 30 cools immediately to hand-touch when shut down which requires only that the power supply be turned off and appropriate adjustments be made to the gas and cooling supplies. Quick electrical, gas, and coolant disconnects, not shown, enable generator 30 to be disconnected and moved from one hearth floor and reconnected at another hearth floor immediately after the end of the soak period. After gas heating stops and during the cooling period, the flow of the atmospheric gas from source 31 is customarily maintained and proportioning valve 34 may be set during this period to bypass all of the plasma gas. Thus, one plasma generator can be used to provide heat for more than one batch furnace on a planned schedule.

Figure 6:
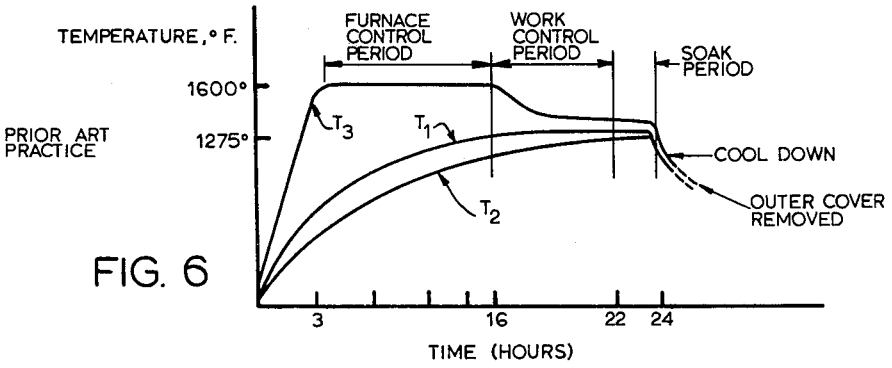
FIG. 6 represents a set of time-temperature curves for a conventional prior art batch furnace.
Figure 7:
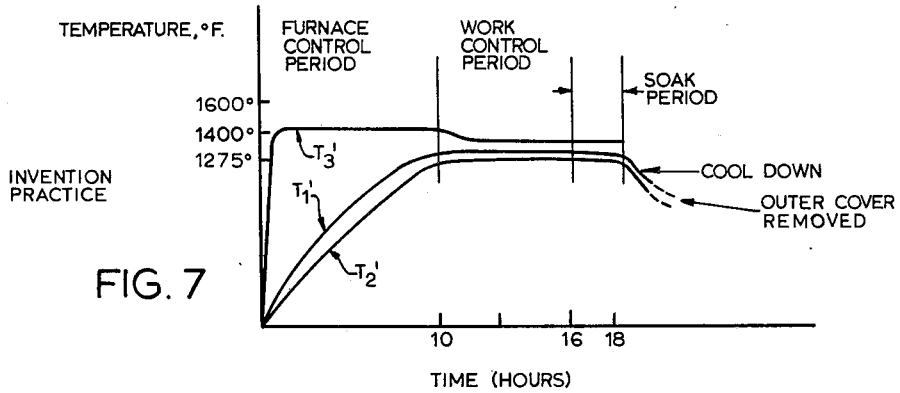
FIG. 7 represents a set of time-temperature curves for the apparatus of the invention.
Figure 8:
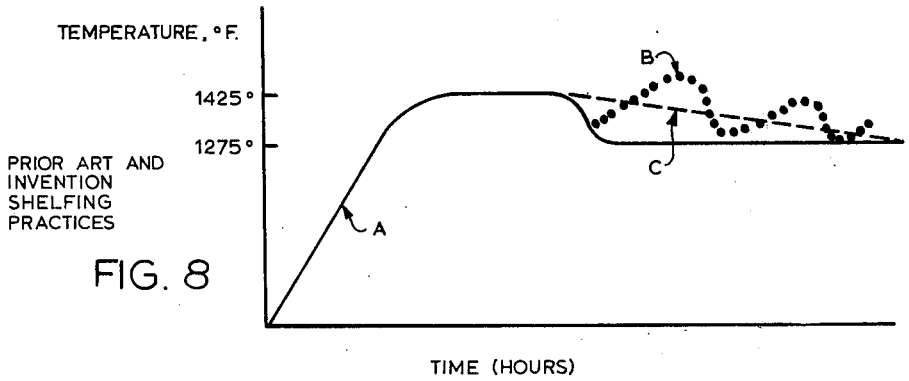
FIG. 8 represents shelfing cycle curves according to the invention and prior art practices.

The description next refers to FIGS. 6, 7, and 8 which show and compare various time-temperature curves of the prior art with those obtainable with the invention. FIG. 6 represents a typical or generalized set of time-temperature curves for a batch-type annealing furnace based on single stack annealing of a 5-coil-high charge of 20-gauge steel (hard coils) of total weight 72,000 pounds. $T_3$ represents the temperature within the outer cover but outside the inner cover as measured near the outer cover radiant tubes. $T_1$ represents the temperature of the charge itself measured at the top of the charge and $T_2$ the temperature of the charge measured at the bottom of the charge. The $T_1$ and $T_2$ thermocouples are conventionally wedged within the coil laps as illustrated in FIG. 1 by thermocouples 37 and 38. Several factors should be noted in FIG. 6: The outer cover space temperature requires about 3 hours to reach 1600°F., the set point of the tube control temperature. The outer cover space temperature must be substantially higher than the inner cover space temperatures until near the end of the work control period, i.e., it must have a temperature "head". The "work control period" cannot be started until about sixteen hours after operations commence. The soak period in the example of FIG. 6 takes place when the difference between top and bottom coil temperatures $T_2$, $T_3$ is within 50°F. Also, in the FIG. 6 example the energy input control to the radiant tubes is taken over by the thermocouple which is measuring the top charge temperatue, i.e., $T_2$, when such temperature reaches the annealing temperature of 1275°F. The thermal efficiency of such a heat treating process is in the order of 50 percent, whereas the thermal efficiency of a process according to the present invention is inherently substantially higher.

FIG. 7 is a generalized set of curves representing a heat treating system, operated according to the invention for comparison with the prior art system on which FIG. 6 is based. In FIG. 7, $T_1'$ represents the coil temperature at the top of the stack (see thermocouple 37 in FIG. 1) and $T_2'$, the coil temperature at the bottom of the stack (see thermocouple 38 in FIG. 1). $T_3'$ represents the temperature of the heated gas mixture entering the inner cover 21 (see thermocouple 36 in FIG. 1) which temperature is essentially equal to the space temperature within inner cover 21.

With respect to FIG. 7, note that the temperature $T_3'$, the inner cover space temperature, rises almost instantly to 1400°F., an arbitrary but generally typical temperature for the invention system. This instantaneous rise should be compared to the time of 3 hours required to reach 1600°F. in the prior art system of FIG. 6. In this regard, note also that the temperature head between $T_3'$ and $T_1'$ in FIG. 7 is less than the head between $T_3$ and $T_1$ in FIG. 6 during the furnace control period. Note also that in FIG. 7 the work control period is shown as being reached in 10 hours as compared with 16 hours in FIG. 7. Mention is again made that FIGS. 6 and 7 are not intended to be accurate or specific as to time or temperature but are shown to point out the very basic and distinct differences in the time-temperature cycles between the prior art and invention processes.

Other advantages of the invention are revealed in the fact that the plasma generator can be made to respond almost instantly to the temperature control. That is, the treating chamber heat within inner cover 21 can follow the measured control temperatures with essentially no lag. In comparison, radiant tube heaters may require from one-fourth to one-half hour to respond to a change in a sensed control temperature. Such fast response in the invention system opens up the possibility for many new kinds of time-temperature cycles not heretofore obtainable.

To supplement what has just been said, reference is made to FIG. 8 in which the curve labeled "A" represents a time-temperature curve for a furnace charge that is much desired in the rod and wire industry in what is called spheroidizing annealing. That is, it is desired to drop quickly and smoothly from an elevated charge temperature to a lesser charge annealing temperature. This is often called "shelfing". Because of the temperature control time lag previously mentioned, the temperature of the charge in a typical radiant tube or direct-fired batch furnace attempts to drift as shown by curve B in FIG. 8 when shelfing is attempted. Thus, the typical practice is to compromise by following a slowly changing curve, represented by curve C in FIG. 8, to avoid the drifting problems of curve B. In comparison, because of the almost instantaneous response of the plasma generator to charge temperature changes and because of the heated atmosphere within inner cover 21 not depending upon heat transfer from radiant tubes to outer cover space, through the inner cover and then on convection, etc., as in the conventional batch furnace, the time-temperature shelfing curve A of FIG. 8 is more readily obtainable by the process of the present invention.

It should be understood that what has been described offers various modes of operation. For example, the annealing process can be accomplished by maintaining relatively constant power to the plasma arc generator and proportioning the amount of treating gas routed through the plasma generator as a means of controlling the charge temperature. Alternatively, the amount of plasma gas routed through the plasma generator may be kept constant and the energy input to the plasma generator varied according to charge temperature. Power supply control and arc length regulation have both been described. Where energy input to the plasma generator is used for control the proportioning arrangement shown in FIG. 1 may not be needed. Of course, plasma gas by passing and plasma generator energy input control may be used together or independently, or one form of control may be used in one part of the time-temperature cycle and another form of control may be used in another part of the time-temperature cycle. Also, cleansing of the gas exhausted through outlets 48 and operation in a closed loop may be employed.

In summary, the invention in its various aspects has been described as a novel arc heated gas annealing apparatus and as a novel method of converting a conventional radiant tube or direct-fired fuel burning batch furnace to a radically different arc heated gas mode of operation. There has also been described a novel method of arc heating an annealing gas as well as a novel process of annealing with such arc heated gas in a batch furnace, with the long arc column plasma generator being the preferred source of such arc in all aspects of the invention.

Those skilled in the art will immediately see many and various types of plasma arc and gas control systems, plasma arc generator configurations and applications of the invention. Also, those skilled in the art will see that the invention adapts both to the type of batch annealing furnace having a fixed hearth floor over which the inner and outer covers are lowered as well as those types of batch annealing furnaces in which the hearth floor is raised into and lowered from a fixed cover configuration. Thus, the present description has not sought to deal with such variations as they will be readily apparent. From the description, it will now be seen that not only have the numerous previously enumerated problems of the conventional batch furnace been eliminated or lessened but there is now given to the art a new apparatus and new method not previously known.

What is claimed is:

1. The method of operating a batch-type annealing furnace of the type having a hearth floor, an inner box-like cover having a closed upper end and a sealable open bottom end adapted to rest about the floor and provide a treatment chamber to enclose the charge to be annealed, an outer box-like cover having a closed upper end and an open bottom end and a refractory lining therein and being adapted to rest surrounding said inner cover, comprising the steps:

a. placing the charge on the hearth floor in a fixed position;
b. placing appropriate temperature sensors proximate the charge;
c. placing the inner cover over the charge;
d. placing the covers so that the outer cover is over the inner cover;
e. purging the chamber formed by the inner cover with an appropriate purging gas;
f. heating a plasma gas with a plasma generator mounted proximate and external of said treatment chamber and directing such heated plasma gas through gas entry paths in said floor to said inner cover chamber to provide a temperature controlled annealing atmosphere for said charge; and
g. sensing with said sensors the temperature within said chamber and using such sensed temperature to control the operation of said plasma generator to control the temperature of said chamber according to some predetermined time-temperature cycle.

2. The method of claim 1 wherein said heating with said plasma generator is with a long arc column plasma generator.

3. The method of claim 1 wherein the said sensing of temperature controls the operation of said generator by controlling the amount of said plasma gas heated by said generator.

4. The method of claim 3 wherein the controlling of said amount of plasma gas heated includes controlling the amount of said plasma gas made to bypass said generator.

5. The method of claim 1 wherein the said sensing of temperature controls the operation of said generator by controlling the power supplied said generator whereby to control the temperature of said chamber.

6. The method of claim 1 including the step of mixing an auxiliary gas with said heated plasma gas prior to said plasma gas entering said chamber.

7. The method of claim 1 including the step of adjusting the length of the arc of said generator according to said chamber sensed temperature as a means of controlling said chamber temperature.

8. The method of heat treating a charge of materials in a treating chamber, comprising the steps of:
a. introducing the charge to the chamber;
b. heating the charge according to some predetermined time-temperature cycle by utilizing at least a continuously flowing portion of the treating gas to sustain an electric arc external of said treating chamber whereby such portion is heated to substantially the desired treating temperature; and
c. directing such heated portion to the chamber to provide the required treating heat for said charge.

9. The method of claim 8 wherein said heating is effected by utilizing an electric arc in a long arc column plasma generator.

* * * * *

UNITED STATES PATENT OFFICE

CERTIFICATE OF CORRECTION

Patent No. 3,980,467 Dated September 14, 1976

Inventor(s) Salvador L. Camacho and James K. Magor

It is certified that error appears in the above-identified patent and that said Letters Patent are hereby corrected as shown below:

Col. 1, line 18, "of" should be --or--.
Col. 1, line 62, "refreactory" should be --refractory--.
Col. 2, line 22, "cooldown" should be --cool-down--.
Col. 2, line 34, one "and" should be deleted.
Col. 3, line 35, "Armeldetag" should be --"Anmeldetag"--.
Col. 6, line 35, "is" should be --it--.
Col. 9, line 3, "is" should be --in--.
Col.10, line 1, "now" should be --not--.
Col.10, line 40, "excusively" should be --exclusively--.
Col 11, line 48, the second appearance of "and" should be --an--.

Signed and Sealed this

Thirtieth Day of November 1976

[SEAL]

*Attest:*

RUTH C. MASON
*Attesting Officer*

C. MARSHALL DANN
*Commissioner of Patents and Trademarks*